US009375597B2

(12) United States Patent
Barker

(10) Patent No.: US 9,375,597 B2
(45) Date of Patent: Jun. 28, 2016

(54) UPPER BODY TONING DEVICE

(76) Inventor: Sidney Ralph Barker, Fort Mohave, AZ (US)

( * ) Notice: Subject to any disclaimer, the term of this patent is extended or adjusted under 35 U.S.C. 154(b) by 222 days.

(21) Appl. No.: 13/468,834

(22) Filed: May 10, 2012

(65) Prior Publication Data

US 2013/0303346 A1 Nov. 14, 2013

(51) Int. Cl.

| | |
|---|---|
| ***A63B 21/00*** | (2006.01) |
| ***A63B 21/018*** | (2006.01) |
| ***A63B 21/04*** | (2006.01) |
| ***A63B 21/055*** | (2006.01) |
| ***A63B 22/20*** | (2006.01) |
| ***A63B 23/12*** | (2006.01) |

(52) U.S. Cl.

CPC ..... *A63B 21/00065* (2013.01); *A63B 21/018* (2013.01); *A63B 21/0428* (2013.01); *A63B 21/0442* (2013.01); *A63B 21/0557* (2013.01); *A63B 21/1469* (2013.01); *A63B 21/154* (2013.01); *A63B 22/203* (2013.01); *A63B 23/1209* (2013.01); *A63B 23/1218* (2013.01); *A63B 23/1254* (2013.01); *A63B 2208/0204* (2013.01)

(58) Field of Classification Search

CPC ..... A63B 21/00; A63B 21/00065; A63B 21/1469

USPC ..... 482/68, 70, 907

See application file for complete search history.

(56) References Cited

U.S. PATENT DOCUMENTS

| | | | | |
|---|---|---|---|---|
| 5,224,909 | A * | 7/1993 | Hamilton | 482/70 |
| 5,295,935 | A * | 3/1994 | Wang | 482/130 |
| 5,328,427 | A * | 7/1994 | Sleamaker | 482/71 |
| 6,607,472 | B2 * | 8/2003 | Toole | 482/123 |
| 7,134,987 | B2 * | 11/2006 | Goldstein | 482/141 |
| 8,113,997 | B2 * | 2/2012 | Fernandez et al. | 482/71 |
| 2009/0098983 | A1 * | 4/2009 | Hoffman | 482/70 |

* cited by examiner

*Primary Examiner* — Jerome W Donnelly

(74) *Attorney, Agent, or Firm* — Schmeiser, Olsen & Watts LLP; Steven J. Miller

(57) ABSTRACT

An upper Body Toning Device includes adjustable handles for various grip positions providing various angles of muscle resistance. The handles may be press inward along carriage guides countered by a resistance element. Multiple resistance elements may be included that may be removable providing adjustable resistance—allowing still yet, more exercises to be performed. A vertical mounting position with accessory hands.

9 Claims, 3 Drawing Sheets

UPPER BODY TONING DEVICE

BACKGROUND OF THE INVENTION

The present invention generally relates to exercise systems, and more particularly, to an upper body toning device.

Exercises devices for developing and toning the upper body typically use, for example, static handles in a fixed position. For example, chin up bars may employ straight bars bolted to a door frame or against a wall surface. The hand grip on a chin up bar can be either over hand or under hand and the hands may be spaced either closer together or farther apart. However, the resistance always remains the body weight of the person sans any additional weight tied to the user.

Other devices my include resistance bands that are hand held with ends pulled apart. This may be effective for movement that pulls away however offers no development for movement that opposes inward forces. Moreover, hand held bands may be difficult to balance when held.

Other more complex equipment may use pulley systems that require different pulleys and handles for each type of exercise performed.

As can be seen, there is a need for an exercise device that can be fixedly mounted while providing inward pushed muscle resistance. There is also a need for a device that can provide adjustability in the handles to allow different angles of attacking muscle development.

SUMMARY OF THE INVENTION

In one aspect of the present invention, an upper body toning device comprises mounting brackets attached to the carriage guides, a pair of carriage guides attached to ends of the mounting brackets, the carriage guides positioned parallel to one another; one handles adjustably coupled to the handle carriage that are slidable along the carriage guides, the handles adapted to be locked into a plurality of fixed positions; and a resistance element connected on one end to one of the mounting brackets and on the other end to a handle carriage attached to the carriage guides.

In another aspect of the present invention, an upper body toning device comprises mounting brackets attached to a pair of carriage guides, the carriage guides positioned parallel to one another; a pair of handle carriages on opposite ends of the carriage guides; one or more handles attached to each handle carriage; and a plurality of resistance elements connected on one end to one of the mounting brackets removably connected on the other end to one of the handle carriages.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention generally provides a device that can be fixed to a vertical support to provide resistance to human body movements. The device promotes toning in the chest, arms, and shoulders of the user.

Figure 1:
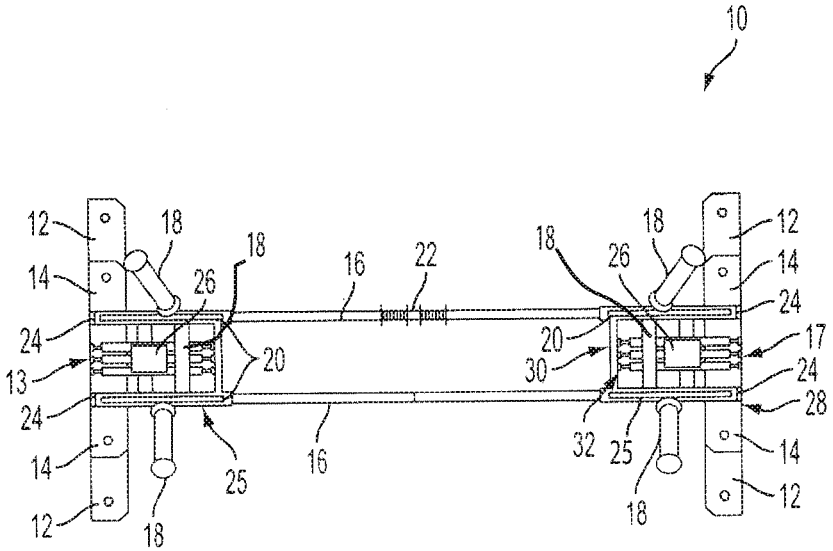
FIG. 1 is a plan view of an upper body toning device according to an exemplary embodiment of the invention.
Figure 2:
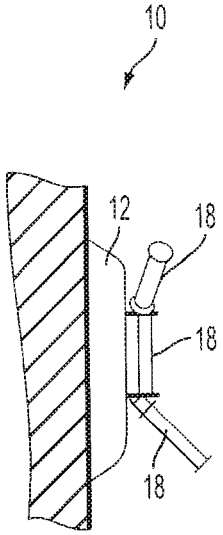
FIG. 2 is a side view of the device of FIG. 1
Figure 3:
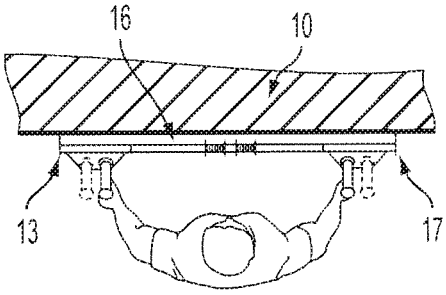
FIG. 3 is a top view of the device of FIG. 1 as used in a laterally mounted position.
Figure 4:
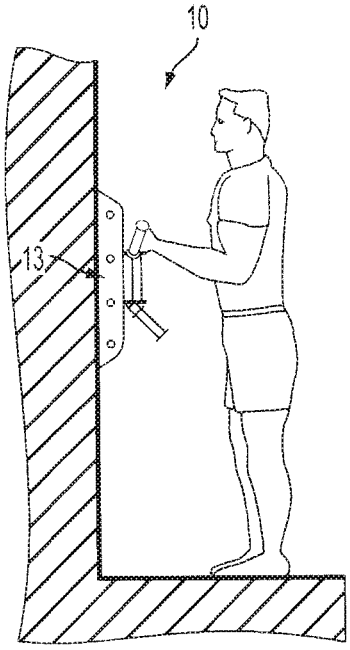
FIG. 4 is a side view of the device of FIG. 3.
Figure 5:
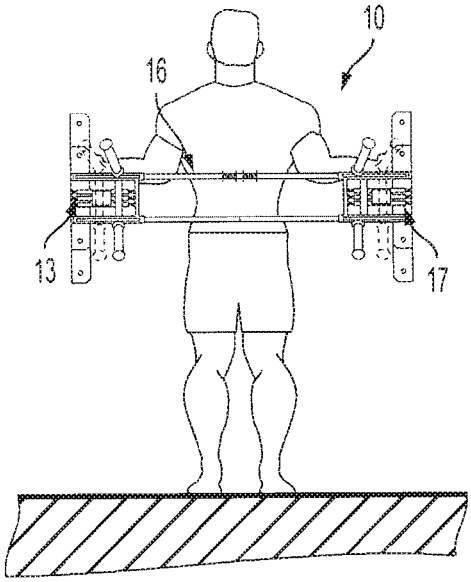
FIG. 5 is a front view of the device of FIG. 3.

Referring now to FIGS. 1 and 2, an upper body toning device 10 according to an exemplary embodiment of the present invention is shown wall mounted. The device 10 may include handles 18, a pair of carriage guides 16, and a resistance element 26 between two or more of the handles 18. The carriage guides 16 may be parallel to one another. The handles 18 may be attached to the carriage guides 16. In an exemplary embodiment, the device 10 may include a left and right side handle carriage 25 The handle carriage 25 may include the handles 18 arranged so that both the left and right sides of the device 10 include an upper handle 18, and a middle handle 18, with the resistance element 26 proximate the upper, lower and middle handles 18 and between the carriage guides 16.

In an exemplary embodiment, the resistance element 26 may be for example, a resistance band or recoil spring. The resistance element 26 may be attached from one end to a mounting bracket 28 via fasteners 24 and from another end to an internal frame support wall 30 on the handle carriage 25. The resistance element 26 may be attached to carriage guides 20 on the handle carriage 25 that are disposed to slide along the carriage guides 16. In an exemplary embodiment, the device 10 may include more than one resistant element 26 per side which may be removably fastened to the support wall 30 by linkages 32 to provide adjustable resistance. A resistance level may be set by attaching from one to three resistance bands or recoil springs. A user may grasp a pair of the handles 18 (left and right side) and, for example, press the handles 18 toward one another along the carriage guides 16. A dampener 22 may be on one of the carriage guides 16, intermediate opposing left and right side resistance elements 26. The dampener 22 may slow down and oppose inward movement of the handle carriage 25 toward one another. Dampeners 24 may also be at the terminal end of each carriage guide 16, however, these dampeners are not shown for sake of illustration.

In one aspect, the device may include adjustable handles 18 to provide various grip positioning of exercises. For example, the handles 18 may use tilt and pivot pins (not shown) to move the handles from one position to be locked into another. The handles 18 may be placed, for example, at three fixed points of hand positioning. Thus, for example, the left and right side upper handles 18 may be positioned to project from a first pitch angle from the mounting surface while the lower handles 18 may be positioned to project from a second pitch angle from the mounting surface.

The device 10 may also include a mounting bracket 12 and a base 14 carrying the handle carriage 25 and carriage guides 16. The carriage guides 16 may have, for example, a length of from about 50 inches to about 54 inches and a diameter or width of approximately 1 inch. The carriage guides 16 may be fastened to the mounting bracket and may extend from end 13 to end 17. The Carriage guides a 16 may also have buffer rings (not shown) at the mounting bracket 12 attaching point for quiet operation.

Referring now to FIGS. 1-5 the device 10 is shown wall mounted in a horizontal position with ends 13 and 17 lateral to one another and the carriage guides 16 parallel to the ground surface, The horizontally mounted device 10 may be installed about chest high for the user.

Figure 6:
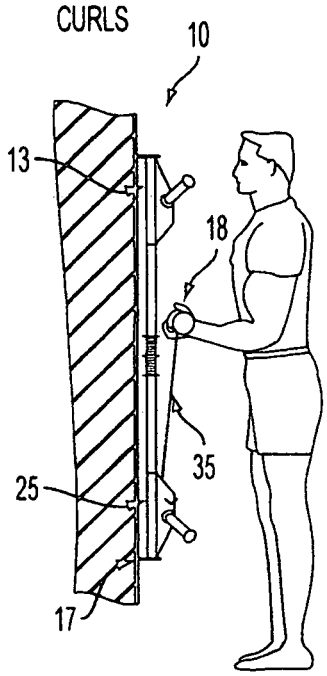
FIG. 6 is a side view of the device of FIG. 1 as used in a vertically mounted position for performing curls.
Figure 7:
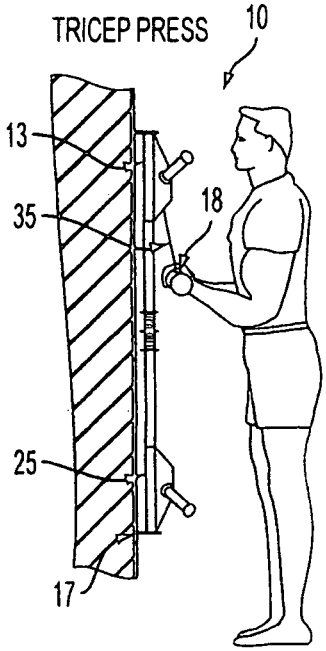
FIG. 7 is a side view of the device of FIG. 6 as used for tricep press.

Referring now to FIGS. 6 and 7, the device 10 is shown wall mounted in a vertical position with ends 13 and 17 being in-line with one another and perpendicular to the ground surface. A separate handle and cable may b attached to a linkage 32 may be drawn up (for example, when performing curling exercises) or pushed downward (for example, during tricep press-down exercises.)

It should be understood, of course, that the foregoing relates to exemplary embodiments of the invention and the modifications may be made without departing from the spirit and scope of the invention as set forth in the following claims.

I claim:

1. An upper body toning device, comprising:

a base fixed to a vertical support wherein the upper body toning device is useable with a user in an upright position;

an outer frame support wall coupled to the base;

a rail coupled to the base;

a sled, comprising an internal frame support wall;

a guide rod coupled to the internal frame support wall and slideably coupled to the guide rail;

a handle coupled to the guide rod; and a resistance element coupled between the outer frame support wall and the internal frame support wall of the sled, wherein the resistance element directionally opposes a sliding movement of the sled along the guide rail away from the outer frame support wall without a pulley.

2. The upper body toning device of claim 1, wherein the handles further comprises an adjustable pitch angle.

3. The upper body toning device of claim 1, wherein two sleds are slidably coupled to the guide rail.

4. The upper body toning device of claim 1, further comprising a dampener coupled to the guide rail at a position along the length of the guide rail.

5. The upper body toning device of claim 1, further comprising a base mount coupled to a vertical supporting structure, wherein the base is coupled to the base mount.

6. An upper body toning device, comprising:

a base comprising two separate pieces;

an outer frame wall attached to each base piece;

a pair of guide rails attached to each base piece; the guide rails positioned parallel to one another, and wherein the base supports the guide rails, wherein the guide rails are exposed on all sides;

a pair of sleds coupled to the guide rails, wherein the sleds slide along a common axis;

one or more handles coupled to each sled; and a resistance element coupled to an outer frame wall and removably coupled to a sled.

7. The upper body toning device of claim 6, wherein the resistance element comprises an elastomeric band.

8. The upper body toning device of claim 6 wherein the one or more handles are removeably coupled to one or more of the sleds.

9. The upper body toning device of claim 6, further comprising a base mount coupled to a vertical supporting structure, wherein the base is coupled to the base mount.

* * * * *